United States Patent [19]

Redmon et al.

[11] Patent Number: 5,024,384

[45] Date of Patent: Jun. 18, 1991

[54] IMPROVED SPRAY APPARATUS FOR CONCRETE FINISHING MACHINES

[76] Inventors: Gerald W. Redmon; Tina L. Redmon, both of 2000 W. Arkansas La., Lot 77, Arlington, Tex. 76013

[21] Appl. No.: 437,073

[22] Filed: Nov. 13, 1989

[51] Int. Cl.[5] ..... B05B 9/00

[52] U.S. Cl. ..... 239/289; 239/332; 404/112

[58] Field of Search ..... 239/332, 337, 172, 289, 239/146, 154, 175, 195, 373, 444, 578, DIG. 6; 404/108, 110, 111, 112, 128, 129; 51/174, 177; 15/50 R

[56] References Cited

U.S. PATENT DOCUMENTS

| | | | |
|---|---|---|---|
| 1,865,109 | 6/1932 | Johnson | 239/172 |
| 3,361,044 | 1/1968 | Wolf et al. | 404/112 |
| 3,534,533 | 10/1970 | Luoma | 239/DIG. 6 |
| 3,857,515 | 12/1974 | Zennie | 239/175 |
| 3,901,449 | 8/1975 | Bochmann | 239/332 |
| 3,904,116 | 9/1975 | Jones et al. | 239/332 |
| 4,296,885 | 10/1981 | Norden et al. | 239/172 |
| 4,331,297 | 5/1982 | Gipson | 239/289 |
| 4,790,454 | 12/1988 | Clark et al. | 239/332 |

*Primary Examiner*—Andres Kashnikow
*Assistant Examiner*—Christopher G. Trainor

[57] ABSTRACT

The invention relates to an improved spray apparatus to be mounted on the frame of a concrete finishing machine. The invention includes an electric battery powered pump that is actuated by a switch on the handle of the machine. A battery holder and a liquid reservoir are secured to a support bracket, and the entire bracket assembly is secured to the frame of the machine. Liquid is supplied by the pump to a pair of spaced spray outlets. The spray outlets are secured close to the surface being finished to minimize disruption of the spray by the wind.

4 Claims, 5 Drawing Sheets

IMPROVED SPRAY APPARATUS FOR CONCRETE FINISHING MACHINES

BACKGROUND OF THE INVENTION

The invention relates to an improved water spray system to be attached on the frame of a machine designed to rotate on a surface. More specifically, the invention relates to a water spray system adapted to be attached to the frame of a concrete finishing machine.

In U.S. Pat. No. 4,331,297 to Gipson, a prior art device is described having a hand-operated water pump mounted on a concrete finishing machine. The prior art device includes a spray nozzle mounted relative]y high on the finishing machine and also a water hose. When wind is blowing between 10 to 20 MPH, the spray of water from the prior art device, because of the height of the spray, is blown away from the surface being sprayed.

Prior to Gipson, no device had been used as an attachment to a concrete finishing machine to spray a surface being finished. A laborer would use a bucket of water or a water hose to apply water to the concrete surface. If the water was not applied in time, the surface would dry out to fast and would not conform to the requirement of being smooth. The improved system eliminates these drawbacks.

SUMMARY OF THE INVENTION

The improved water spray system is to be attached on a frame of a concrete finishing machine. The system includes a battery powered liquid pump which supplies liquid from a reservoir to a surface to be finished.

When liquid is needed to finish the surface, the improved system can be actuated immediately by pushing and holding in an electric switch. Upon actuation, fluid is sprayed towards the surface from two spaced outlets. The electric pump and switch enable spraying to be accomplished faster and easier then was possible in the prior art.

Liquid is supplied to the spray outlets from the liquid reservoir through tubing. A tee connector divides the liquid between the two spray outlets. A check valve is located upstream of the tee connector to instantly shut off liquid flow when the system is not operating.

The reservoir and a battery case are supported on a support universal bracket. The support universal bracket allows the respective system's components to be easily secured to the finishing machine.

The advantages and objects of the improved system will become easy to see from the following detailed description of the drawings when read in connection with the accompanying drawings which illustrate the preferred embodiments of the invention.

DETAILED DESCRIPTION

Figure 1:
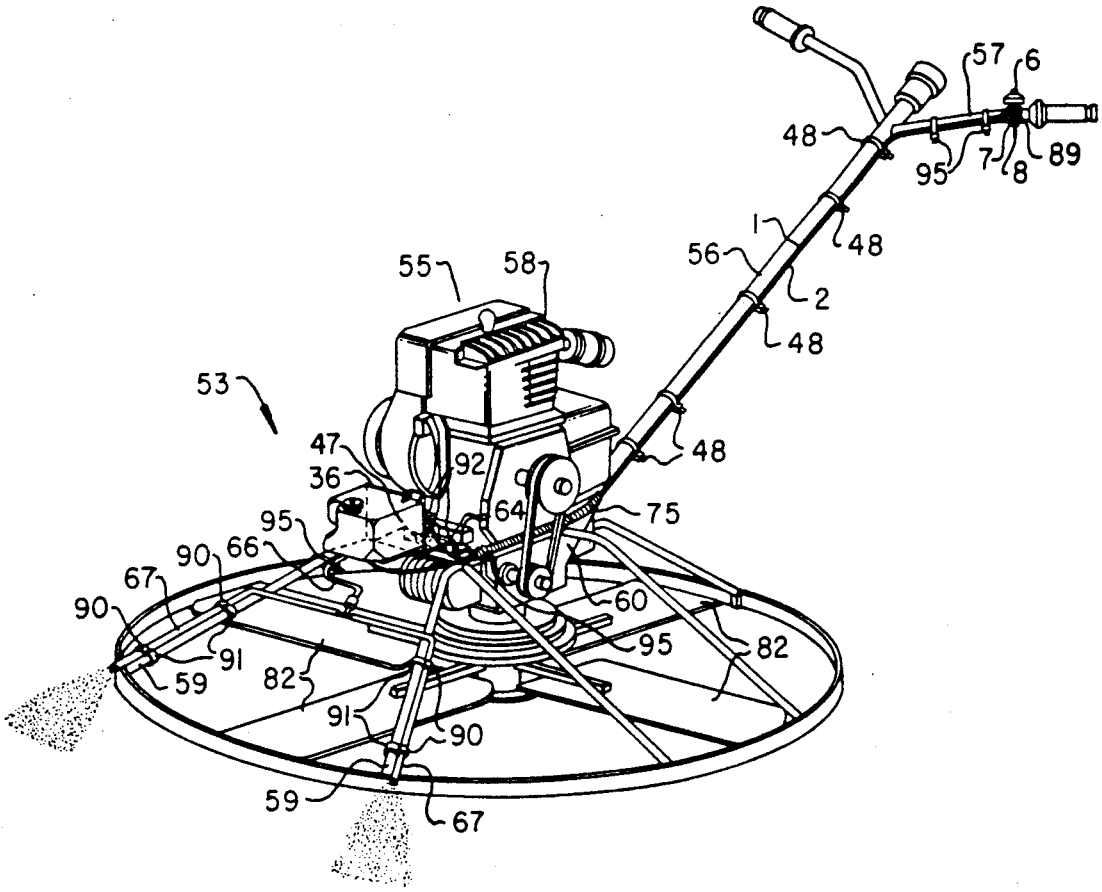
FIG. 1 is a perspective view of the improved sprayer system attached on the frame of a concrete finishing machine.

In FIG. 1, the improved water spray system is designated by a general reference numeral 53. The spray system is mounted on a frame 60 of a concrete finishing machine 55. The concrete finishing machine includes equipment to rotate on a surface 82 to be finished, and a handle bar 57.

An electric switch 6 is mounted about a rubber ring 89 on the handle bar of the machine by a clamp 7 and screws 8. The rubber ring 89 allows the clamp 7 to be firmly secured about the handle bar 57. Disposed beneath the electric switch 6 are a pair of terminals 84 including terminal connectors 4 and screws 5. The screws 5 function to connect the terminal connectors 4 to the top ends of electrical wires 1 and 2.

Figure 3:
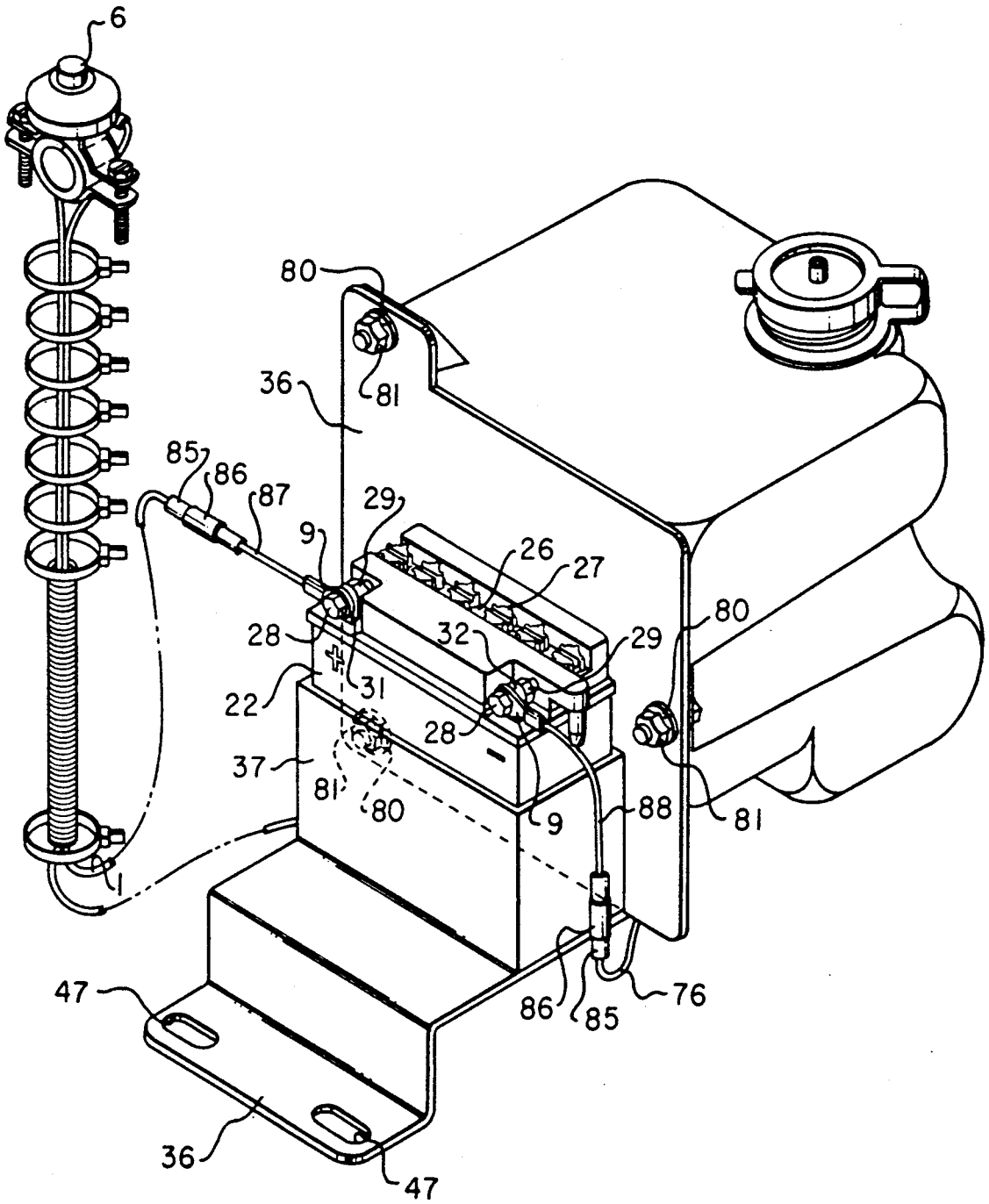
FIG. 3 is a back view of the improved sprayer system.
Figure 4:
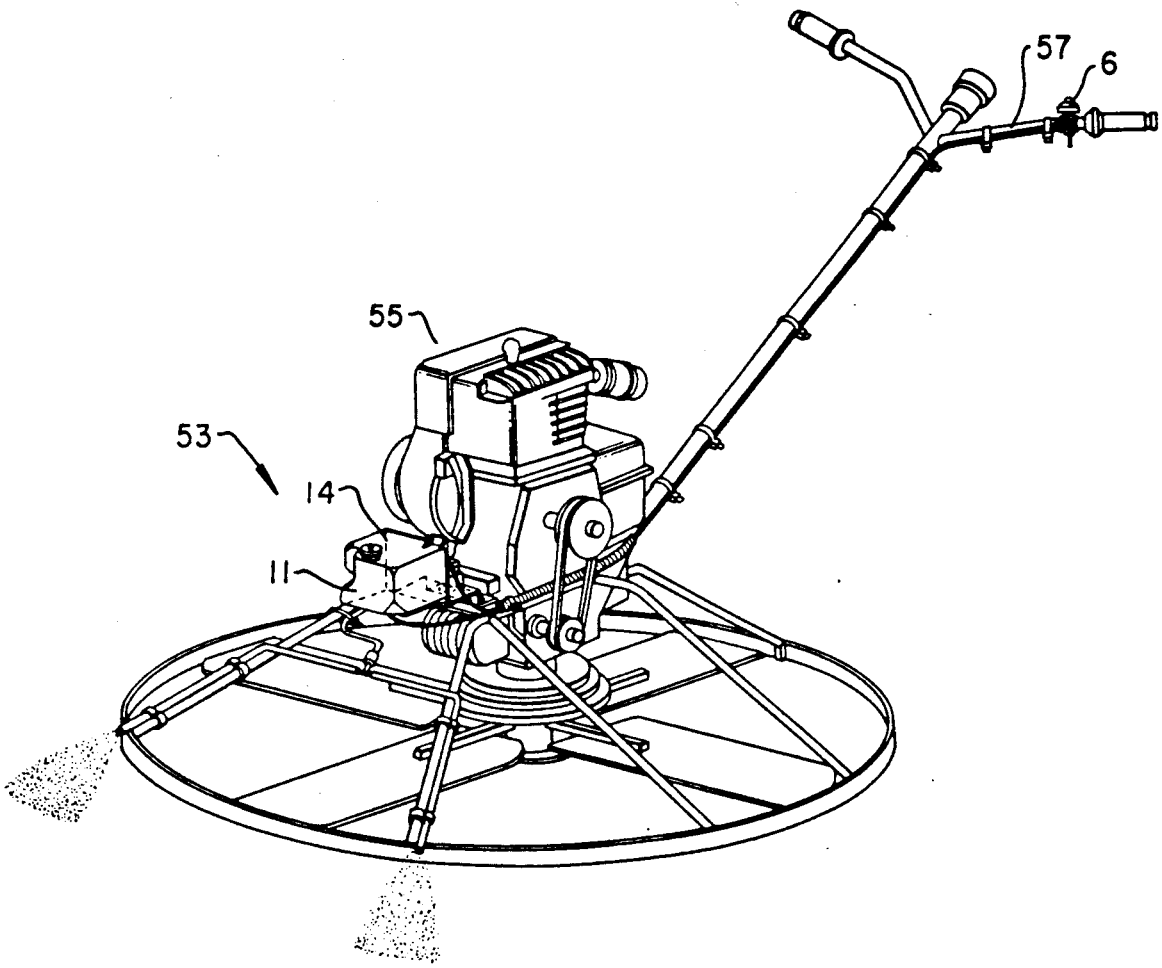
FIG. 4 is a side view of the improved sprayer system attached on the frame of a concrete finishing machine.
Figure 5:
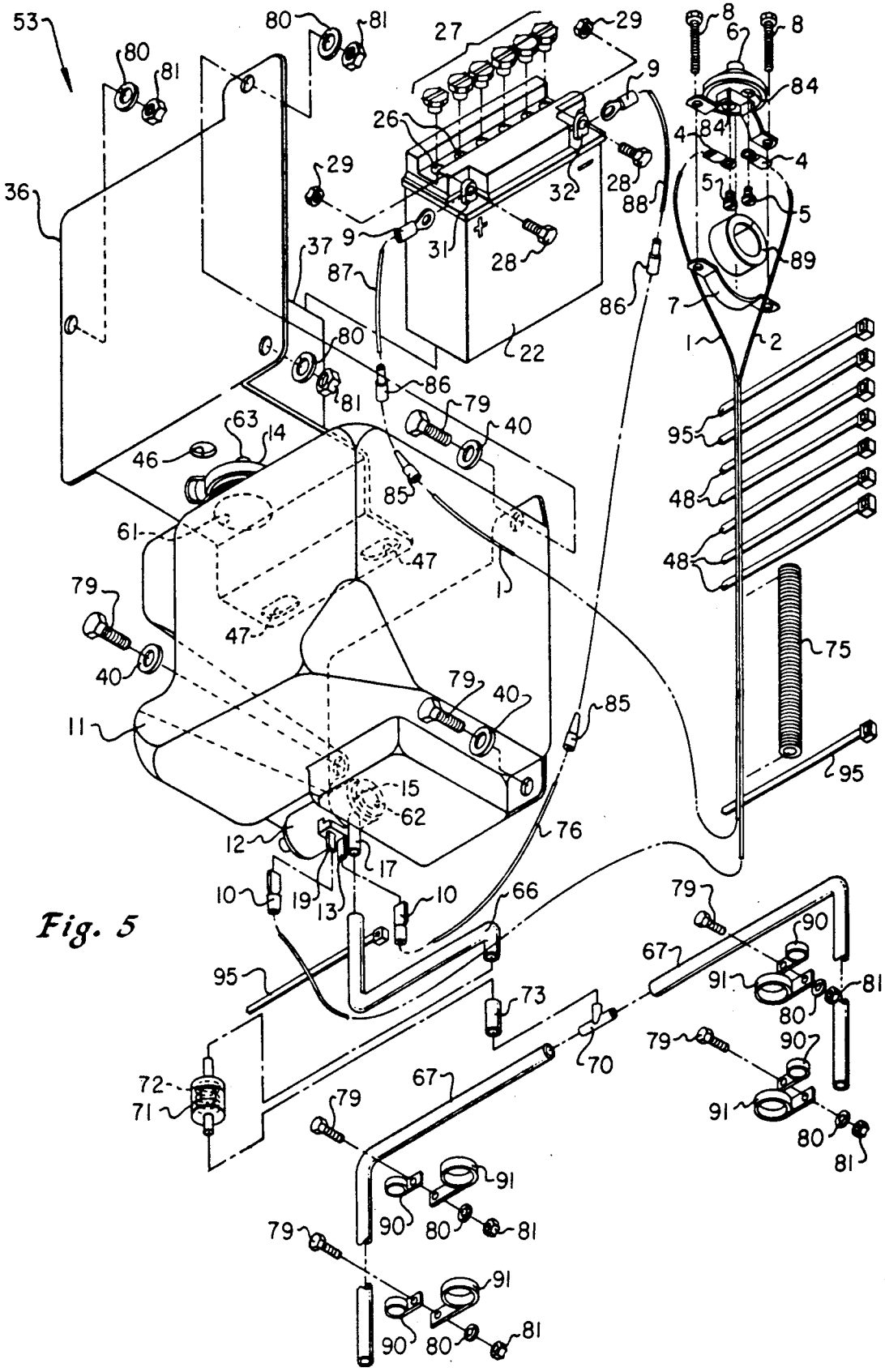
FIG. 5 is an exploded view of the sprayer system.

As shown in FIG. 3, a battery 22 is encased in a battery case holder 37 which is supported on the back of a support universal bracket 36. The battery includes cells 26 having vent caps 27. A hole 46 in the center of the battery case holder 37 provides for liquid drainage.

The base of the support universal bracket 36 is, as shown in FIG. 1, secured to the frame 60 of the concrete finishing machine 55. The bracket 36 includes holes 47 which receive bolts 64, nuts 65 and washers 92 to facilitate securement. Different size nuts, bolts, and washers may be required to secure the support universal bracket 36 on the frames of different machines.

Figure 2:
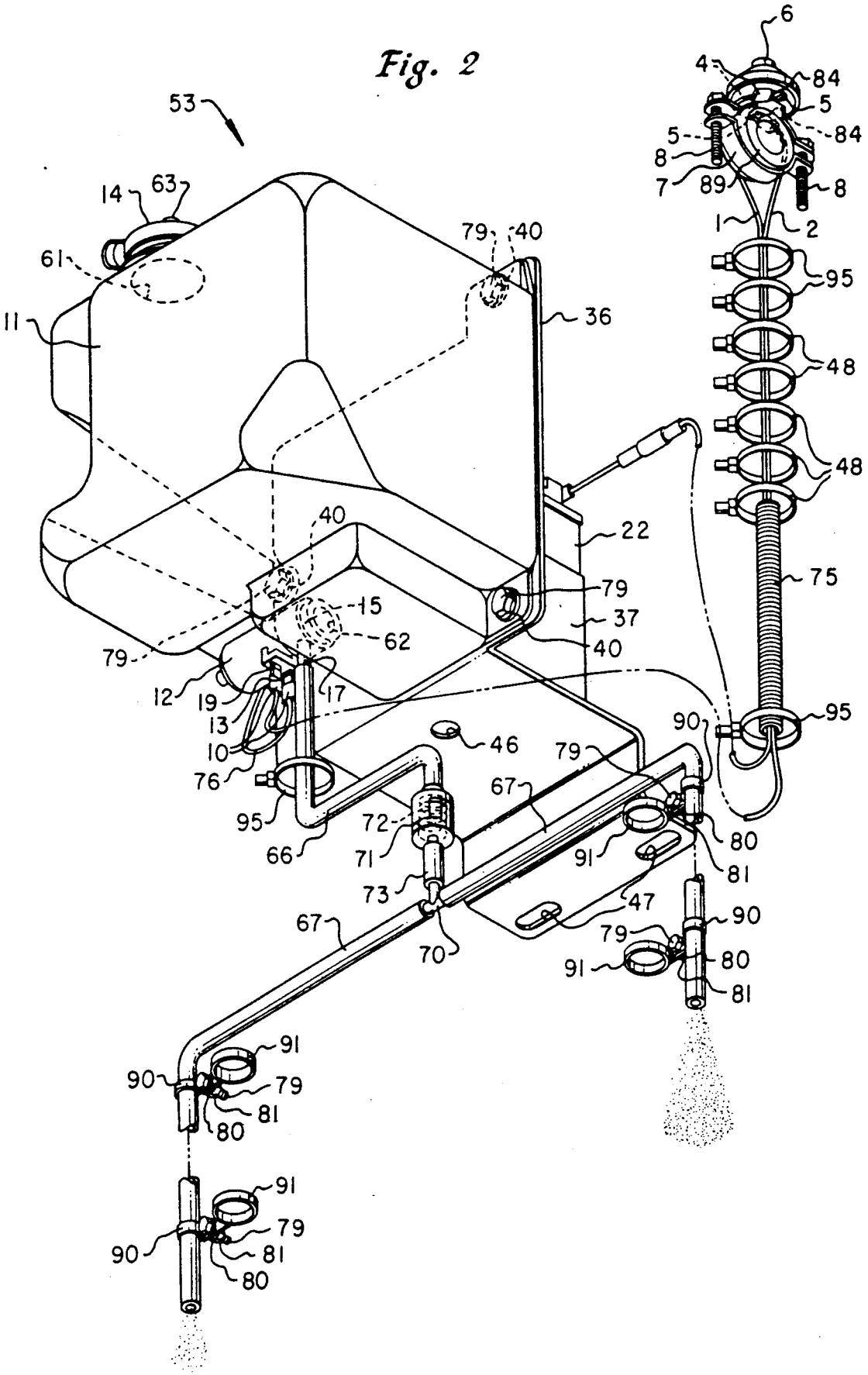
FIG. 2 is a front view of the improved sprayer system.

As shown in FIG. 2, a reservoir 11 is secured on the front of the support universal bracket 36 by bolts 79, washers 40, nuts 81 and lock washers 80. The reservoir 11 is used to store liquid which is to be supplied to the spray system, and includes an inlet 61, an outlet 62, and a top lid cover 14. The top lid cover 14 has hole 63 which prevents pressure build up in the reservoir 11. The cover 14 is lifted to fill the reservoir 11.

As shown in FIG. 1, the electric wires 1 and 2 are secured along a handle 56 and a motor 58 of the concrete finishing machine 55 by ties 48 and 95. Insulation 75 is located by the side of the motor 58 to protect the wires 1 and 2 from the heat.

As shown in FIG. 3, the opposite end of the electric wire 1 is connected to a bullet terminal connector 85. The bullet terminal connector 85 is connected to a line connector 86 which is connected to electrical wire 87. The opposite end of the electrical wire 87 includes a terminal connector 9 which is connected to the positive (+) terminal 31 of the battery 22 by a bolt 28 and a nut 29.

The opposite end of the electrical wire 2 is connected to a push on terminal connector 10 which is connected to the positive terminal 13 of an electric pump 12. The negative terminal 19 of the electric pump 12 is connected to electrical wire 76 via push on connector 10. The opposite end of the electrical wire 76 is connected to a bullet terminal connector 85. The bullet terminal connector is connected to a line connector 86 which is connected to an electrical wire 88. The electrical wire 88 is connected to a terminal connector 9 which is connected to the negative terminal 32 of the battery by bolt 28 and nut 29. The bullet terminal connectors 85 and line connectors 86 provide for quick disconnecting to facilitate recharging of the battery 22. The battery 22 provides electrical current to the electric pump 12 via the electrical switch 6 such that upon depression of the switch 6, power s supplied to the pump 12.

The electric pump 12 has an inlet 15 and an outlet 17. The pump inlet 15 communicates with the reservoir outlet 62. The pump outlet 17 is connected to tubing 66. The tubing 66 is secured on a brace 59 of the concrete finishing machine by a tie 95, and communicates with a check valve 71 having a spring 72 that holds the valve 71 closed when the system is not operating. Tubing 73 connects the outlet of the check valve 71 to a tee connector 70. The tee connector 70 divides the liquid being supplied between a pair of tubes 67.

The tubes 67 are supported on the sides of each of the front braces 59 of the machine 55 by clamps 90 and 91. The clamps 90 and 91 are secured in place by bolts 79, lock washers 80, and nuts 81. It is noted that different clamps may be required for different machines.

Upon depression of the switch 6, the electric pump 12 supplies liquid from the reservoir 11 to the outlet of the tubes 67 to spray the liquid in two different directions at the same time to finish the surface. To stop spraying, the electric switch 6 is released. The outlet of the tubes 67 are disposed close enough to the surface being finished to prevent the wind from blowing the liquid away from the surface.

We claim:

1. An improved water spray apparatus for attachment to a concrete finishing machine having a handle bar, a motor, a frame, and a plurality of front braces, the improved apparatus comprising:

an electric pump having an inlet and an outlet;

a liquid reservoir having an inlet, an outlet, and a top cover;

a battery supported in a battery case holder and having positive and negative terminals, said battery case holder having a drainage hole;

an electric switch attached to the handle bar of the finishing machine, a support universal bracket having a plurality of holes, said holes receiving bolts to secure the support bracket to the frame of the finishing machine;

supply tubing interconnecting the reservoir outlet and the pump inlet and extending from the pump outlet to a pair of spray outlets, said supply tubing being attached along the front braces of the finishing machine by clamps, said spray outlets being disposed close to the surface being finished to prevent winds from substantially disrupting the direction of the spray;

electrical wiring electrically connecting the battery, the pump, and the switch, said wiring including a pair of bullet connectors at the positive and the negative battery terminals to facilitate recharging of the battery;

wherein the battery case holder is secured to the back of the support bracket and the reservoir is secured to the front of the support bracket, said reservoir being secured to the support bracket by a plurality of bolts, and wherein upon depression of the electrical switch, liquid from the reservoir is pumped to the spray outlets to spray the surface being finished.

2. The improved spray apparatus of claim 1, further including insulation means to insulate the electrical wiring from heat of the motor.

3. The improved spray apparatus of claim 1, further including a tee connector in the supply tubing to divide the liquid between the two spray outlets.

4. The improved spray apparatus of claim 1, further including a check valve tubing.

* * * * *